US006060994A

United States Patent [19]

Chen

[11] Patent Number: 6,060,994

[45] Date of Patent: May 9, 2000

[54] METHOD FOR CONTROLLING UNITED HOME SECURITY SYSTEM

[75] Inventor: Scanner Chen, Taipei, Taiwan

[73] Assignee: Tempa Communication Inc., Taipei, Taiwan

[21] Appl. No.: 09/233,941

[22] Filed: Jan. 20, 1999

[51] Int. Cl.[7] ..... G08B 23/02; G08B 1/00

[52] U.S. Cl. ..... 340/825.06; 340/506; 340/521; 340/539; 340/531; 340/825.69; 379/37; 379/38; 370/913

[58] Field of Search ..... 340/506, 825.06, 340/521, 539, 531, 825.69; 379/37–39; 370/913, 912

[56] References Cited

U.S. PATENT DOCUMENTS 5,787,429 7/1998 Nikolin, Jr. ..... 340/825.54
5,889,474 3/1999 LaDue ..... 340/825.49
5,892,690 4/1999 Boatman et al. ..... 340/825.06
5,917,405 6/1999 Joao ..... 340/426
5,963,136 10/1999 O'Brien ..... 340/573.1

*Primary Examiner*—Donnie L. Crosland
*Attorney, Agent, or Firm*—Dougherty & Troxell

[57] ABSTRACT

A control method for united home security system includes steps of defining a set of signal codes which are transmitted between a client-side monitor/control server and a remote administrant through a public telecom-network by using multiple frequency signals. When the server sends signals to the remote administrant, a data string which is assembled by following a predefined format is received and checked by the remote administrant. An event handling process will be performed if the data string is correct. The remote administrant performs a predetermined handling process which is corresponding to the incident code sent by the server. The remote administrant start performing a rescue process when receiving an emergency/rescue handling signal from the server.

5 Claims, 8 Drawing Sheets

METHOD FOR CONTROLLING UNITED HOME SECURITY SYSTEM

BACKGROUND OF THE INVENTION

1. Field of the Invention

This invention relates to a novel united home security system, and more particularly to a method for controlling the united home security system through a public telecom-network.

2. Description of the Prior Art

Conventional home security systems usually need wires or cables to layout the signal transmitting lines and connected subsequent lines. The alarms, emergency buttons, commonly shared lighting signals should all be installed separately in each of the united client users' house and then be wired all together. When one of these users of the shared security system pushes the emergency button, all the alarms and lighting signals of these users' houses will be switched on all together so as to achieve the function of promulgation and calling for help. Such conventional home security system only needs commonly used circuit technology (e.g., serial or parallel connections of circuits) to construct its circuitry and control center.

However, such kind of conventional control circuit and control technology not only has limited security function but also has various deficiencies such like the shared power supply, shared devices and parallel connected cables are very easy to be damaged, for example, damaged by mouse bitten. Once any part of the shared lines is damaged, all other users may very likely to be interfered, and the whole system will also deem to be paralyzed.

In addition, such conventional corded layout technique not only needs to punch or drill holes on the buildings but also likely to be restricted by the geographical environment, signal wires may bared on the ground when extending from one building to the other, short-circuit happens from time to time, and so on. All these deficiencies of prior art home security system have left a room for further improvement.

SUMMARY OF THE INVENTION

In view of aforesaid disadvantages, it is therefore a primary object of the present invention to provide a powerful home security system which can accommodate a lot of client users under protection of this united home security system via a public telecom-network. Under the novel design of the united home security system in accordance with the present invention, if any incident occurred on any client user, he/she can immediately call all of the predetermined allied neighbors, police stations, life-guard agents, community watch teams, or local administrants.

Another objective of this invention is to provide a control method for the united home security system. By using the control method in accordance with the present invention, a high security and reliability means for signal transmission and communication can be provided, such that a better control of the united security system can be achieved.

A further object of this invention is to provide a control method for united home security system which comprises the following steps: defining a set of signal codes which are transmitted between the server and the remote administrant through the public telecom-network by using multiple frequency signals. When the server sends signals to the remote administrant, a data string which is assembled by following a predefined format is received and checked by the remote administrant. An event handling process will be performed if the data string is correct. The remote administrant performs a predetermined handling process which is corresponding to the incident code sent by the server. The remote administrant starts performing a rescue process when receiving an emergency/rescue handling signal from the server.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
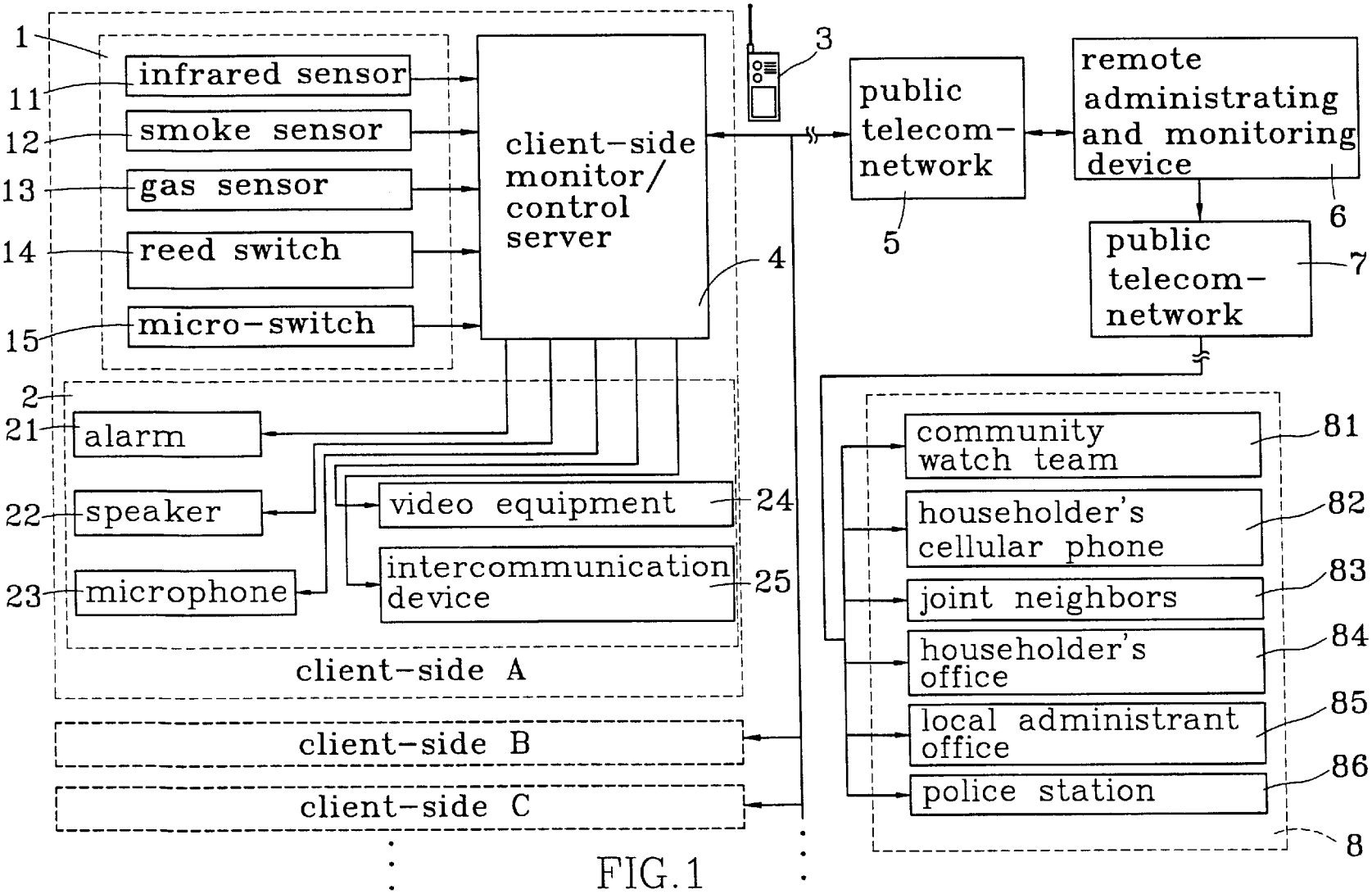
FIG. 1 is a block diagram illustrating a preferred embodiment of the controlling architecture of the united home security system which includes a plurality of client users.

Referring to FIG. 1, which illustrates a preferred controlling architecture of the united home security system in accordance with the present invention. A plurality of client users (e.g., client-side A, client-side B and client-side C) are included in the system. Each of the client-sides, for example client-side A, is installed with a security peripheral sensing circuit 1, a client-side monitoring circuit 2, a remote controller 3, and a client-side monitor/control server 4.

All client-side monitor/control servers 4 of the client-sides are connected to a first public telecom-network 5(e.g., PSTN or INTERNET). The united home security system of the present invention also includes a remote administrating and monitoring device 6 and a promulgating network 8. The remote administrating and monitoring device 6 is connected between the client-side monitor/control server 4 through the public telecom-network 5 for every client user and the promulgating network 8 through a second public telecom-network 7 for dialing and signal transmitting purposes. Where the transmission for sending control, alarm, group promulgate or remote control signals between the client-side monitor/control servers 4, remote administrating and monitoring device 6, and the promulgating network 8 is based on encoded Dual Tone Multi-Frequency signals (DTMF) which is well known in this field.

Various types of sensor units or detectors can be employed in the security peripheral sensing circuit 1 for providing different kinds of detecting functions, such like infrared sensor 11, smoke sensor 12, gas sensor 13, magnetic reed sensor 14, micro-switch 15, and etc. Depending on their own functions and characteristics, these sensor units can be furnished at a suitable location at the client-side (for example: door, window, corridor, or kitchen) for detecting the situation of that location. The sensing signals of these sensor units will be transmitted to the client-side monitor/control server 4 by using corded or cordless transmitting means, such that the client-side monitor/control server 4 will be able to access the overall conditions arisen at the client-side.

Client-side monitoring circuit 2 is used to send emergency alarm signals or do other activities in response to an incident at the client-side under the control of the client-side monitor/ control server 4 or remote administrating and monitoring device 6 when a pre-determined incident arisen. For example, the client-side monitoring circuit 2 may include an alarm 21, a speaker 22, a microphone 23, a video equipment 24, and an intercommunicating device 25.

The remote controller 3 allows the client user (e.g., householder) to setup, reset, or switch on/off the client-side monitor/control server 4, which may be a handset unit.

When the client-side monitor/control server 4 receives a signal from any of aforesaid sensor units, that signal will be transmitted to the remote administrating and monitoring device 6 via the public telecom-network 5, and then be decoded and explained and sent by the remote administrating and monitoring device 6 to the promulgating network 8 via the public telecom-network 7. The promulgating network 8 may include a community watch team 81, a householder's cellular phone 82, a united neighbors 83, a householder's office 84, a local administrant office 85, a police station 86, and etc.

Figure 2:
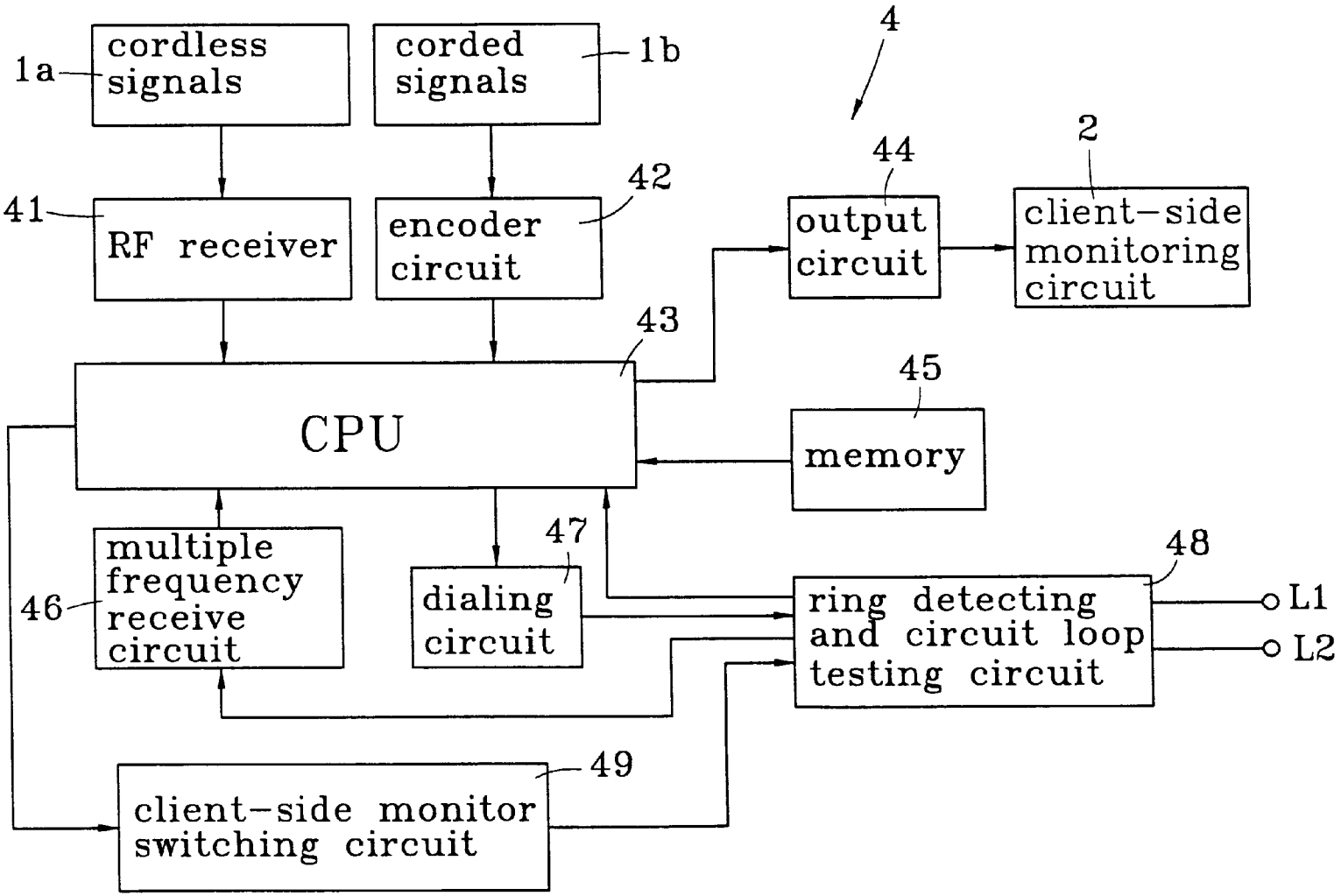
FIG. 2 is a block diagram illustrating the internal circuitry of the client-side monitor/control server shown in FIG. 1.

FIG. 2 illustrates the internal circuitry of the client-side monitor/control server 4 shown in FIG. 1. The internal circuitry of the client-side monitor/control server 4 includes:

- a RF (Radio Frequency) receive module 41 for receiving cordless signals 1*a* from the remote controller 3 and the security peripheral sensing circuit 1, and then the cordless signals 1*a* are verified and sent to a central processing unit 43 (CPU) by the RF receive module 41;
- an encoder circuit 42 for receiving corded signals 1*b* from the peripheral sensing circuit 1, when the encoder circuit 42 receives a corded signal 1*b*, then a respondent BCD code will be generated and sent to the central processing unit 43 for further processing;
- a central processing unit 43 for controlling the client-side monitor/control server 4;
- an output circuit 44 for receiving control signals from the central processing unit 43 so as to control or drive the devices of the client-side monitoring circuit 2;
- a memory 45 for keeping the communicating codes, coding tables and control software during the signal transmission for the central processing unit to assemble, resolve and control sequential actives;
- a multiple frequency receive circuit 46 for decoding multiple frequency signals received from a ring detecting and circuit loop testing circuit 48 and then sending these decoded signals to the central processing unit 43, the central processing unit 43 will then control the output control or switch on/off the communication circuit based on the format of the decoded signals;
- a dialing circuit 47 which is controlled by the central processing unit 43 for providing dialing function so as to connect to the remote administrating and monitoring device 6 and send multiple frequency signals for communicating with the remote administrating and monitoring device 6 based on the format of the decoded signals;
- a ring detecting and circuit loop testing circuit 48 connecting to the telephone lines L1 and L2 for sensing the ringing signals and testing if the telephone feedback circuit is under normal operation; and
- a client-side monitor switching circuit 49 controlled by the central processing unit 43 for switching between voice recording, alarm, mute, and dialogue functions at the client-side.

Figure 3:
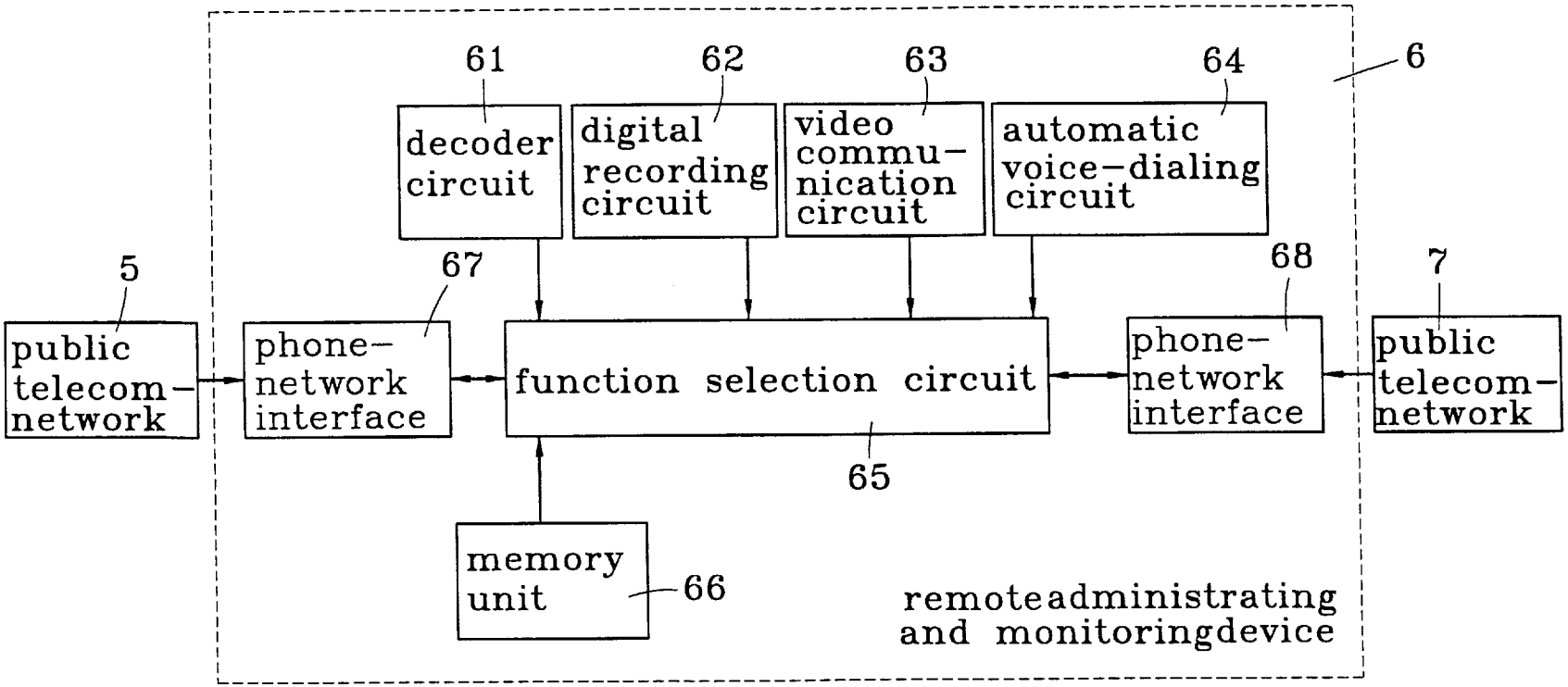
FIG. 3 is a block diagram illustrating the internal circuitry of the remote administrating and monitoring device shown in FIG. 1.

FIG. 3 illustrates the internal architecture of the remote administrating monitoring device 6, comprising:

- a decoder circuit 61 for decoding and reading the encoded dual tone multi-frequency signals from the client-side monitor/control server 6 through the public telecom-network 5;
- a digital recording circuit 62 for recording voice messages corresponding to some specific events, such like "thief is intruding", "scoundrels are causing trouble", "someone needs help", "fire alarm" and etc.;
- a video communication circuit 63 for providing visional communication between the remote administrating and monitoring device 6 and the client-side if needed;
- an automatic voice-dialing circuit 64;
- a function selection circuit 65 for switching one function to another, the function selection circuit 65 being connected with the public telecom-networks 5 and 7 via the phone-network interfaces 67 and 68; and a memory unit 66 for storing records of clients and programs for controlling group promulgation, alert, and security remote control.

By means of aforesaid architecture of the security system, individual client-side can connect to the remote administrating monitoring device 6 via the PSTN public telecom-network 5 for transmitting various signals (which are corresponding to various types of events) thereto. During signal transmission, in addition to traditional fixed-code assembly technology, random-code technology can also be used for better security of signal transmission.

For example, sequential varied assembly method may be applied to encode and transmit the dual tone multi-frequency (DTMF) signals, so as to prevent the signals from being decoded, transformed, or damaged on purpose during transmission. The formats of transmitted signals comprise: signal identification, re-coding format, client-side off-line, alert, stop response to signal codes, re-transmit, promulgation, video communication, ask for emergency help, fire alarm, gas leakage, power down, window open, front door or rear door open, audio-video monitoring, and etc.

After the remote administrating and monitoring device 6 decodes and reads the signals sent from the client-side, it can actively control the client-side monitoring circuit 2 for performing functions of broadcast monitoring, communication, photo taking, alarm control, remote control of electric appliances, cancel off-line condition, and etc.

In the mean time, the remote administrating and monitoring device 6 dials a predetermined phone number to connect with a specific communication device such like a pager, cellular phone, fire brigade, police station, local administrant office and etc. (as the promulgating network 8 shown in FIG. 3). Thereby, any unexpected event can be promulgated to appropriate place, device or person immediately and the progress of the event will be kept tracked of until that event is well resolved.

FIGS. 4 to 8 illustrate the flow charts of the control processes of the present invention. The following description takes an eight-lines telephone as an example to conduct the present invention, wherein the first six lines (e.g., line Nos. 1 to 6) are used by the client-side monitor/control server 4 for calling up the remote administrating and monitoring device 6 to proceed subsequent control processes, while the rest two lines (e.g., line Nos. 7 and 8) are used by the client users to call the device 6 to proceed client service processes.

In order to make the following description more concise, hereafter the client-side monitor/control server 4 will be referred as the "server", and the remote administrating and monitoring device 6 will be referred as the "remote administrant".

The present invention defines a serial of signal codes which can be transmitted via the multiple frequency signals of the public telecom-network. These signal codes can be used by the server to communicate with the remote administratnt.

A preferred example of the predetermined signal codes are listed in the following Table 1 and Table 2. Table 1 shows the event codes for the server to call the remote administrant.

TABLE 1

| Code | Content of Event | Server Response Code |
|---|---|---|
| 00B | first type emergency: telephone still on line | 0399B |
| 01B | second type emergency: push the emergency button | 0399B |
| 02B | third type emergency: oldster, children need assistance, medical assistance required | 02B |
| 03B | window open | 0399B |
| 04B | glass shattered | 0399B |
| 05B | front/rear door open | 0399B |
| 06B | human body detected by infrared sensor (including ultrasonic sensor) | 0399B |
| 07B | rear door open | 0399B |
| 08B | gas leakage | 0399B |
| 09B | smoke sensor | 0399B |
| 10B | flame/overheat detector | |
| 11B | low power alert | |
| 20B | alert condition setup | 01B |
| 21B | alert condition release | 02B |
| 22B | remote setting of alert condition (via telephone) | 01B |
| 23B | remote releasing of alert condition (via telephone) | 01B |
| B | end-of-signal | |

Table 2 shows the event codes of a preferred embodiment of the present invention for the remote administrant to call the server.

TABLE 2

| Code | Content of event |
|---|---|
| 00B | inform server to hang up the phone (stop connection) |
| 01B | inform server to play one short-lasting and one long-lasting BEEP sounds (first type of sound) |
| 02B | inform server to play three short-lasting and one long-lasting BEEP sounds second type of sound) |
| 03B | inform server to play loud and high decibel alarm sounds (third type of sound); (parameter can be included for duration of sound, for example: 0399B) |
| 04B | switch on the first type monitoring device |
| 05B | switch on the second type receiving device |
| 06B | switch on the third type dialogue device |
| 10B | two short-lasting and one long-lasting sounds |
| 19B | inform server to call the pager three times, then play the first type of sound until the client user release the condition |
| 08B | play the second type of sound until the condition is released |
| 09B | play the first type of sound until the condition is released |
| 12B | payment overdue, switch the operation mode of the server |
| A | send out signals |
| B | end-of-signal |

Figure 4:
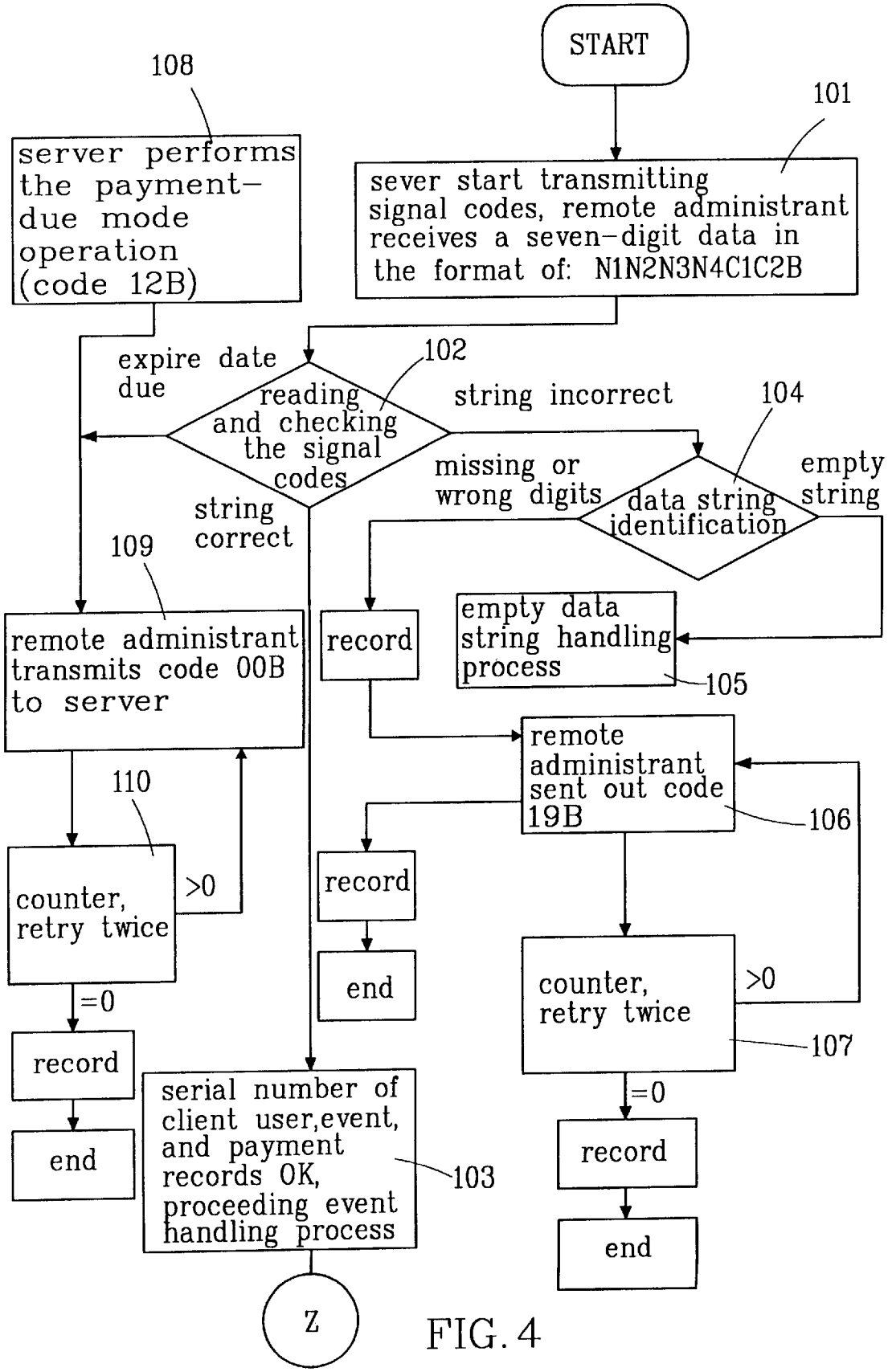
FIGS. 4 to 8 are flow charts illustrating the control processes of the united home security system in accordance with the present invention.

Please refer to FIG. 4 which illustrates the primary control process of the present invention. The control process comprises the steps of:

Step 101, when one of the first six lines of telephone receives a call from the server, the remote administrant sends a signal informing the sever to start transmitting the signal codes. Then the remote administrant will receive a set of data from the server containing seven digits which are preferably in the following format:

N1N2N3N4C1C2B wherein: N1~N4 are serial numbers of client user
C1 and C2 are event codes
B is "end-of-signal" code After executing the step 101, the remote administrant will decode and read the seven digits data. If the data is in correct format, then the step 103 will be proceeded for performing a predetermined event handling process corresponding to the event codes. In the step 103, the transmitted codes will be checked and recorded. The items being checked in the step 103 include: serial number of client user, event, and payment records. If these items are in normal condition, then the event handling process is proceeded. In addition, some items such like the date, time, serial number of client user, event, and reason for not allowed to log-in will also be recorded during the step 103.

In the step 102, if the transmitted codes (i.e., the seven digits data) contain invalid information, then the step 104 will be proceeded to identify the reason of incorrect codes. If the transmitted codes are invalid due to empty string (i.e., none digit at all), then the step 105 will be proceeded which contains the following record/handle procedures:

1. indicates that the sever got problem in sending codes
2. indicates that the remote administrant got problem in receiving codes
3. indicates the connection of telephone lines is unstable
4. if such invalid transmitted codes occurred successively after a predetermined number of times (for example, ten times), then the remote administrant will automatically present an alert message on a monitor and start alerting (voice alert).

In the step 104, if the transmitted codes are invalid due to missing or undefined digits (the codes will be re-transmitted and re-checked twice), then this situation will be recorded, and the remote administrant will send the code 19B to the sever (as shown in step 106). Referring to Table 2, when the server receives the code 19B, the server will dial the client user's pager number three times and play first type of sound (code 01B) until the client user releases this condition by himself/herself.

In the control processes of the present invention, when the remote administrant send out the code 19B to the server as illustrated in the step 106, the server will also send a response code (can also be referred as feedback code) back to the remote administrant. The remote administrant will finish its code sending process only after the response code is received and recorded such that the delivery of code 19B can be confirmed. By applying such a feedback process, if the remote adminstrant receives an invalid response code, then the step 107 will be proceeded for retrying (re-send the code twice, for example). The step 107 is performed by setting a counter with a value of two and then subtracting one from that value whenever the code 19B is sent once. If that value is not equal (greater than) to zero, then the re-sending of the code 19B will be repeated until zero is reached. When that value reaches zero, then the process will be stopped and the condition will be recorded.

Figure 5:
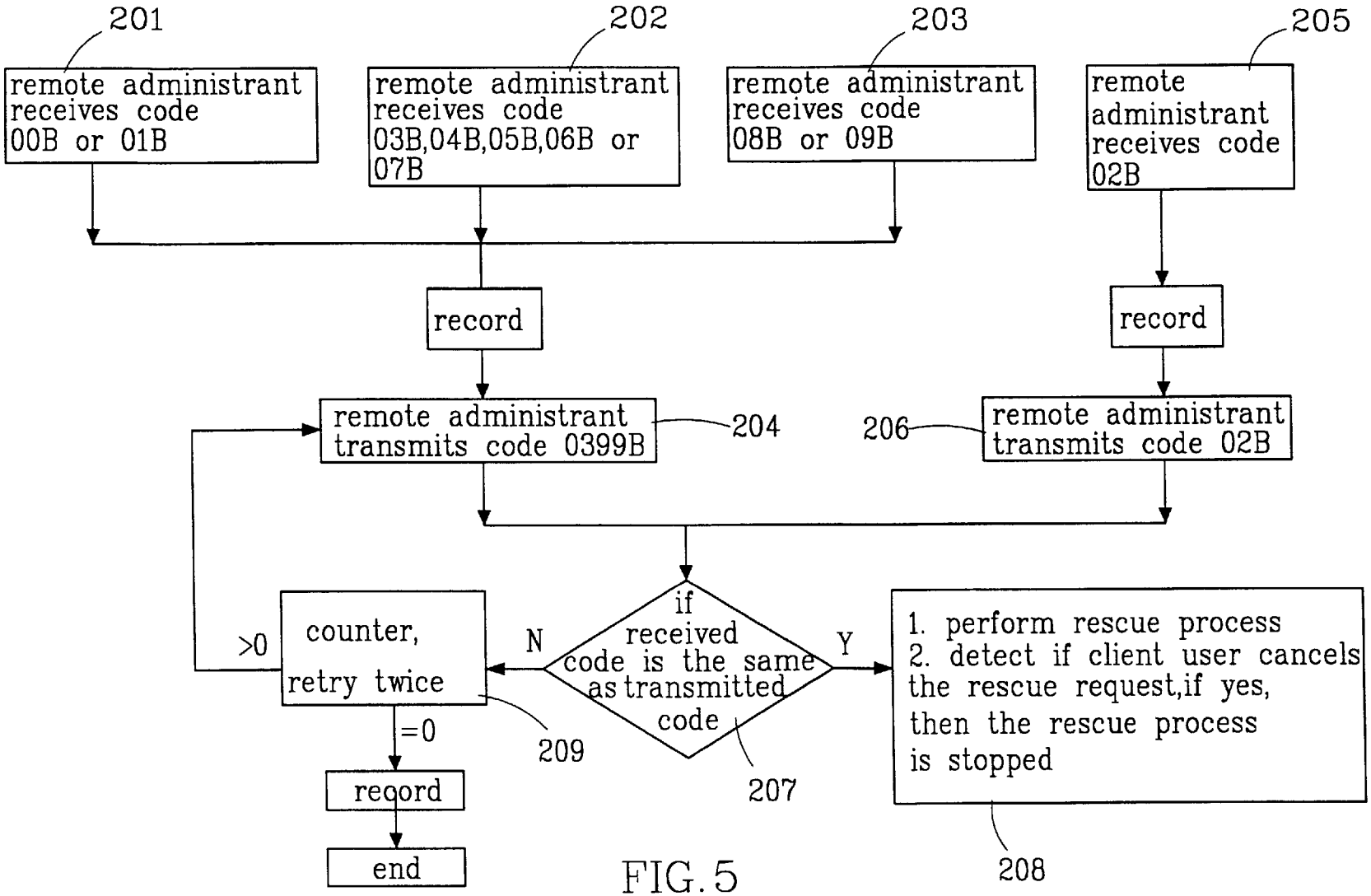

In the step 102, if the transmitted codes contain a serial number belongs to a client user whose payment has already overdue (e.g., it is time to stop service), then the payment-due mode will be performed by the server as shown in the step 108 (code 12B). Under such a payment-due mode of operation, the last time of united home security service may still be provided. After then, the united home security service will not be provided anymore, and the client user can only use his/her client-side monitoring device to conduct off-line functions. Therefore, when the united home security service is stopped, the remote administrant transmits the code 00B to the server (step 109) for informing the server to cut off the power and communicating connections. A confirming process (step 110) can also be included for confirmation the cut off process. These processes will then be completed after being recorded by the remote administrant. FIG. 5 illustrates the emergency/rescue handling process, which follows the process "Z" shown in FIG. 4. That means, after proceeding the "going through the event handling process" of the step 103 shown in FIG. 4, the emergency/rescue handling process shown in FIG. 5 will then be proceeded.

In this process, if any of the following events is occurred, such as the emergency rescue of the step 201 (e.g., the remote administrant receives the code 00B or 01B shown in Table 1), the intrusion rescue of the step 202 (e.g., the remote administrant receives the code 03B, 04B, 05B, 06B or 07B shown in Table 1), or the fire/gas rescue of the step 203 (e.g., the remote administrant receives the code 08B or 09B shown in Table 1), the remote administrant will first record the code, then proceed the step 204, and then transmit the code 03B as shown in Table 2 to the sever for alarming loudly with high decibel sound. In addition, when designing the program of the present invention, the code 03B may also be modified to be 0399B which means the alarm sound will last for ninety-nine seconds.

As shown in FIG. 5, if the sever sends out the code 02B for indicating an oldster/weakling rescue request (step 205), the remote administrant will first record it and then perform the step 206. In the step 206, the remote administrant sends out the code 02B for informing the sever to play an alarm sound which contains three short-lasting and one long-lasting BEEP sounds.

When the remote administrant receives the event codes in the steps 204 and 206, the remote administrant will first verify these codes (step 208) and also detect that if the client user cancels the rescue request by himself/herself or not. If the rescue request is canceled, then the subsequent corresponsive rescue process is stopped. The rescue process may includes:

1. call the male master's pager
2. call the female master's pager
3. call the male master's office telephone
4. call the female master's office telephone
5. call the first neighbor's telephone
6. call the second neighbor's telephone
7. call the police station
8. call the telephone pre-determined by the client user In the step 207, if the remote administrant receives an incorrect signal code, then a retry step (step 209) will be performed, and then this event will be recorded and this process will be ended.

Figure 6:
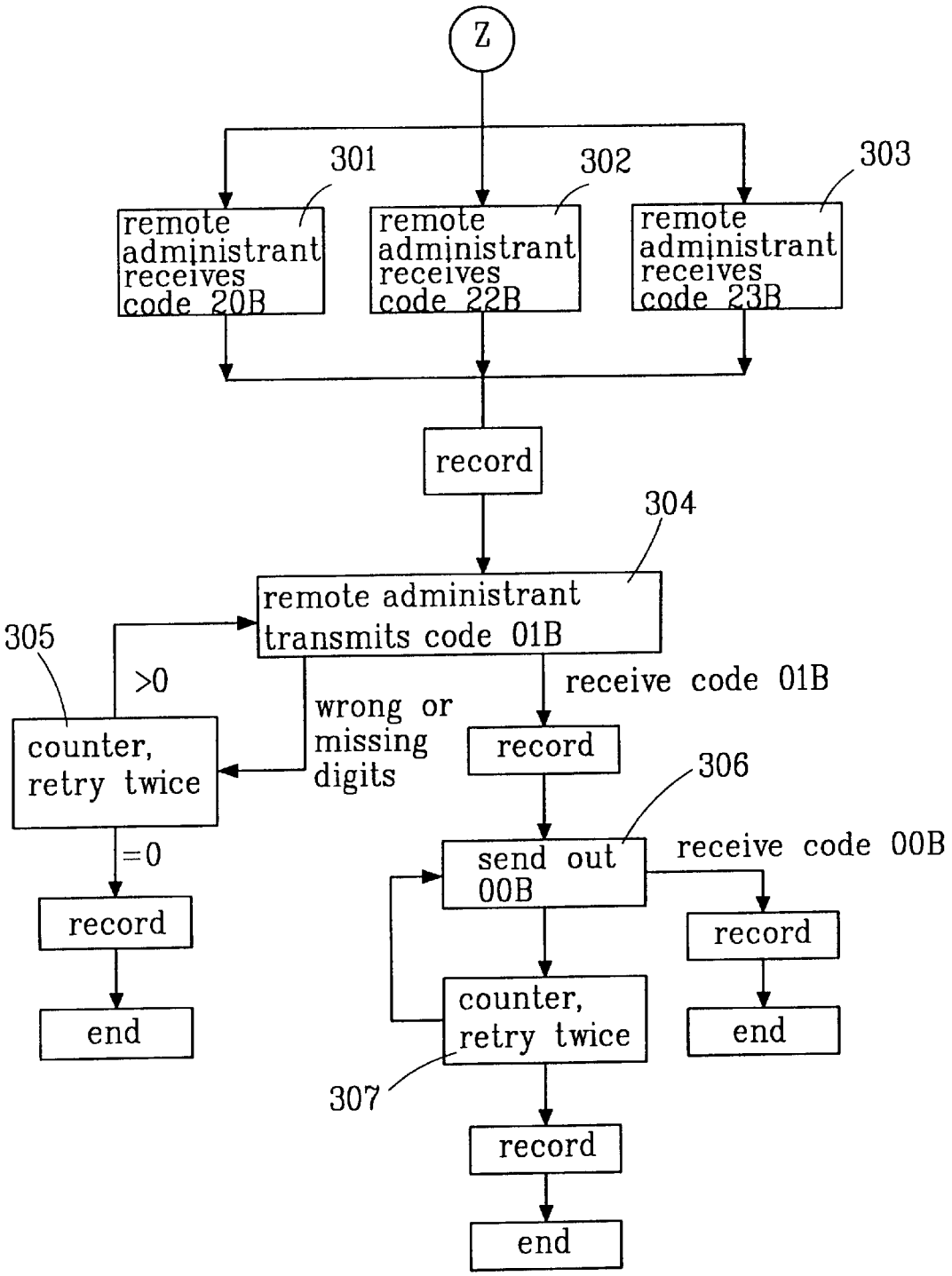

FIG. 6 shows a flow chart illustrating the processes of client-side alarm setting performed by using a remote controller, alarm setting performed by using a remote telephone, and alarm cancellation performed by using a remote telephone. In the FIG. 6, when the remote administrant receives an order requesting the process of the client-side alarm setting performed by using a remote controller of the step 301 (code 20B shown in Table 1), alarm setting performed by using a remote telephone of the step 302 (code 22B shown in Table 1), or alarm releasing performed by using a remote telephone of the step 303 (code 23B shown in Table 1), such an order/code will first be recorded, and then the remote administrant sends back the code 01B (shown in Table 2) to the server for informing the server to play an alarm sound which contains one short-lasting and one long-lasting BEEP sounds. In the mean time, the server sends a responsive code 01B (as shown in the column "server responsive code" of Table 1 in response to the signal codes 20B, 22B or 23B) back to the remote administrant. If the signal received by the remote administrant is to release alert condition, then the code 00B will be sent (step 306) and the retry process (step 307) will be performed.

In the step 304, if the remote administrant receives an incorrect data, such as wrong code or missing of string, then the retry process of the step 305 will be performed.

Figure 7:
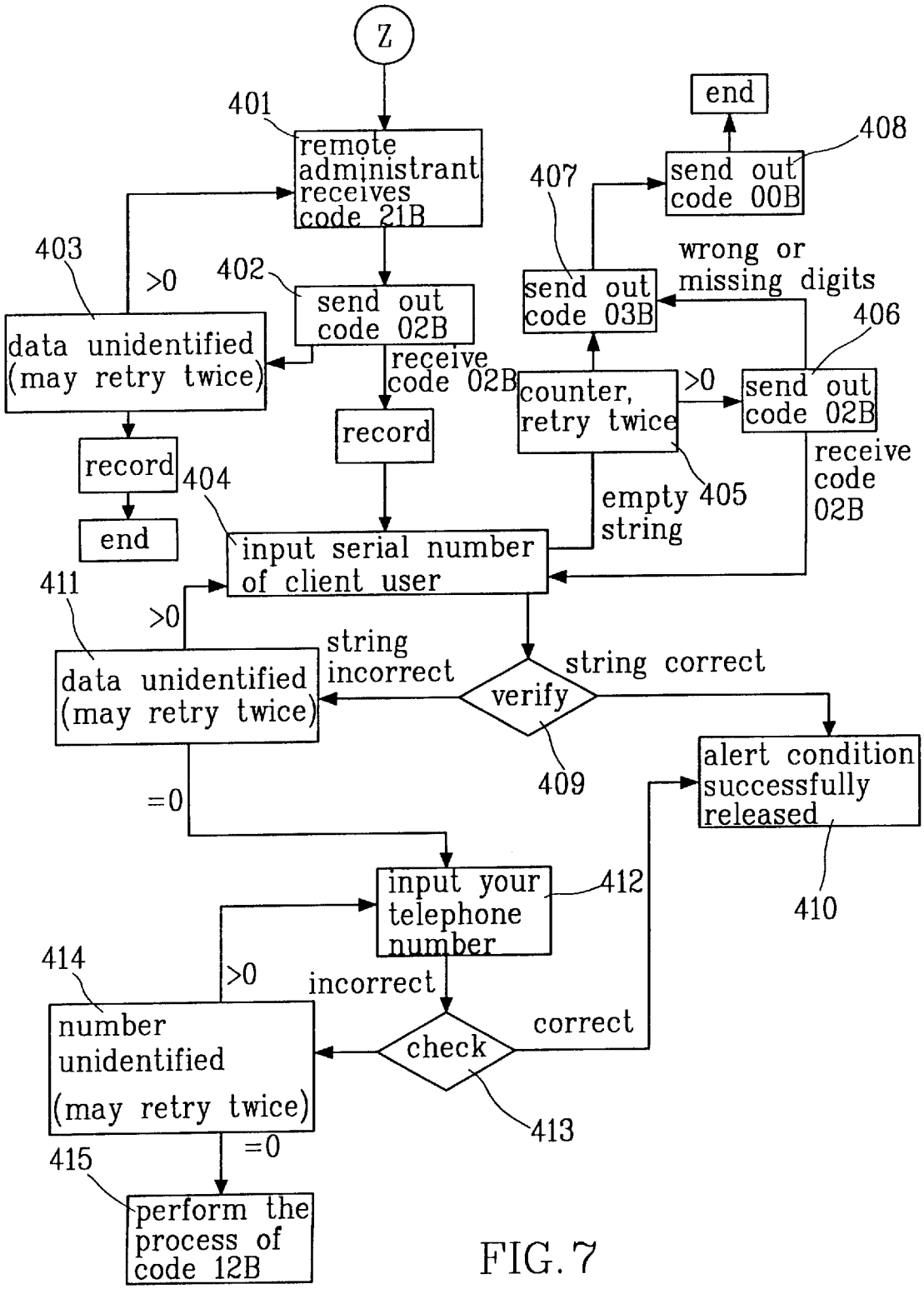

FIG. 7 illustrates the handling process for releasing the alert condition by using the remote controller. When the remote administrant receives the code 21B shown in Table 1(step 401), the remote administrant will send the code 02B (shown in Table 2) to the sever so as to inform the server to play an alarm sound which contains three short-lasting and one long-lasting BEEP sounds. The server will then send a responsive code back to the remote administrant. If the remote administrant receives an incorrect responsive code (e.g., wrong or missing digits), then the step 403 will be performed for retrying. When the signal codes are correct, then the remote administrant will ask the client user to input his/her serial number within a predetermined of time limit, for example, twenty seconds. If the remote administrant does not receive any data string within the time limit, then the retry process of the step 405 will be performed and the code 02B of Table 2 will be sent to inform the server to play an alarm sound which contains three short-lasting and one long-lasting BEEP sounds. If there is still no correct serial number being input after retry process, then the remote administrant will send the code 03B of Table 2 to inform the server to play an alarm sound which is loud and high decibel and proceed rescue process (step 408).

When the serial number of client user is input in the step 404, the serial number will be checked and verified. If the serial number is correct, then the alert condition will be released (step 410). If not, then the "data unidentified" signal will be sent and the retry process will be proceeded. If no correct serial number is input in the retry process, the client user will then be requested to input his/her telephone number (step 412). The input telephone number will be compared with an originally pre-stored user's phone number (step 413). The alert condition can still be released if the input telephone number matches the pre-stored number during the comparison (step 410). If the telephone number is incorrect, then the "number unidentified" signal will be sent (step 414) and the retry process will be proceeded. If the telephone number is still incorrect after retrying, the remote administrant will then proceed the operation mode instructed by the code 12B of Table 2. Wherein the operation mode is to switch the server to operate under payment-due mode (step 415).

Figure 8:
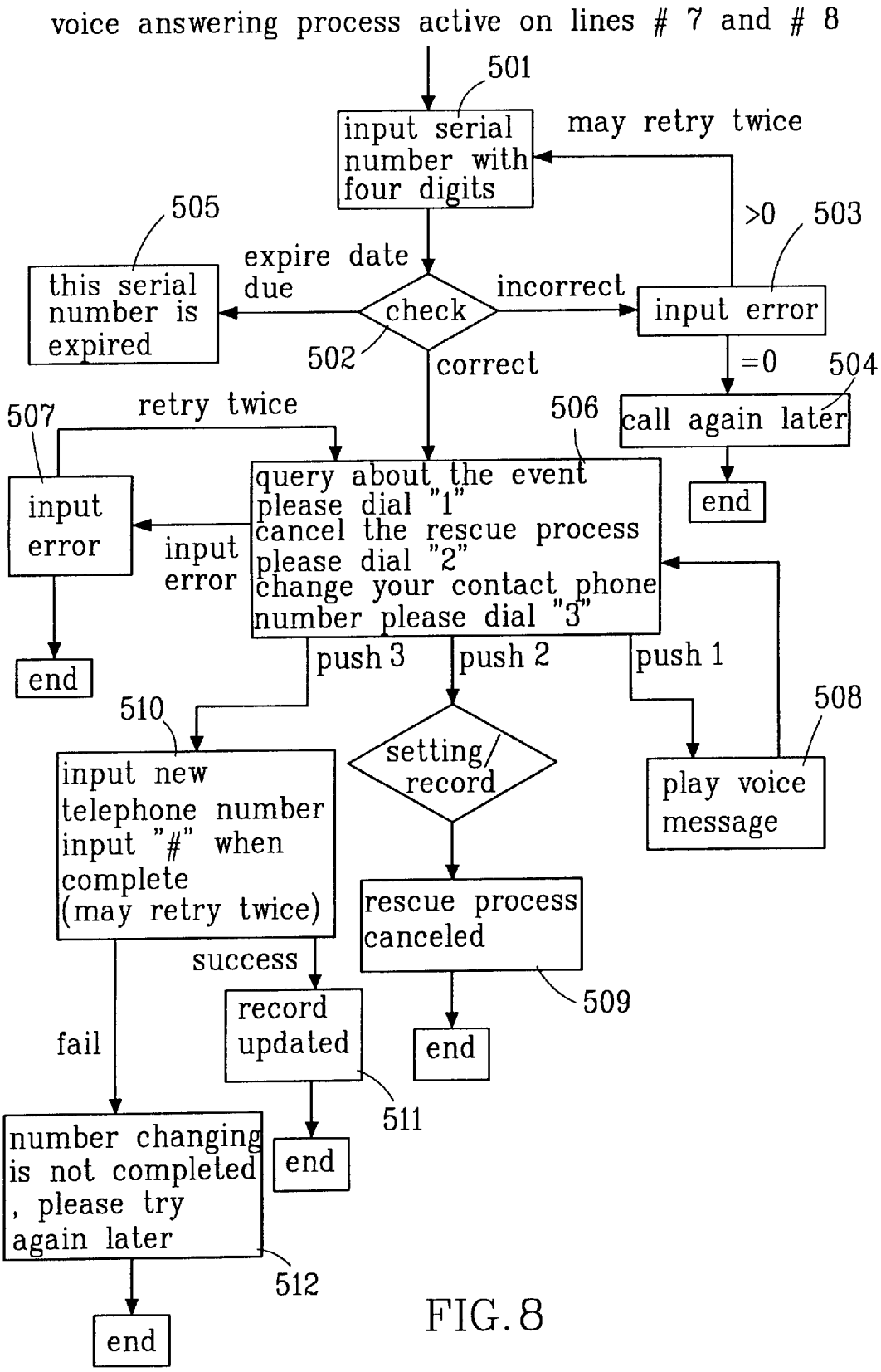

FIG. 8 illustrates a preferred embodiment of the voice answering process (e.g., the client user calls the remote administrant and the remote administrant answers the client user) which is active on the rest two lines (e.g., line No. 7 and 8) of the aforesaid eight-lines telephone. Firstly, the remote administrant asks the client user to input his/her serial number with four digits (step 501). The input number is then verified at the step 502. If the client user's serial number is incorrect (which can be retried for twice), then the "input error" voice message will be played (step 503) and the client user will be requested to call again after he/she has made sure his/her serial number (step 504).

If the remote administrant finds the expire date for using the serial number is due (e.g., payment overdue) in the step 502, then "this serial number is expired" voice message will be played (step 505).

If the serial number input at the step 502 is correct and valid, then the remote administrant will send out the following voice messages:

1. query about the event please dial "1";

2. cancel the rescue process please dial "2";

3. change your contact phone number please dial "3";

The client user will be asked for retrying at the step 507 if an incorrect number is input. If the client user choose "1", then the remote administrant will play one of the pre-recorded messages referring to the specific event.

Wherein a preferred example of the pre-recorded voice messages in accordance with the present invention may includes:

1. General Terms

| Terms | Content of Voice Message |
|---|---|
| 1 | this is asking for emergency help, asking for emergency help |
| 2 | assistance needed |
| 3 | my name is . . . |
| 4 | my telephone number is . . . |
| 5 | my address is . . . |

2. Specific Terms

Get information from database, for example, client user's name, telephone number (use first listed number if more than one number were recorded), or address.

3. Event Terms

| Code | Content of Voice Message |
|---|---|
| 00–01 | ruffian threatening, ruffian threatening |
| 02 | oldster/children needing assistance, oldster/children needing assistance |
| 03–06 | thief intruding, thief intruding |
| 07 | server losing contact with system for unknown reason, or condition being released for unknown reason |
| 08–09 | fire accident or gas leakage, fire accident or gas leakage |

When the client user calls the remote administrant to query about the event, only the Event Terms corresponding to the specific event is automatically played for lasting two minutes. If the rescue process is performed, then the remote administrant will call a specific person/place/device and play all of the General Terms, Specific Terms, and Event Terms, and such a voice message will be repeated for lasting three minutes.

In the step 506, if "2" is input, then the remote administrant will cancel the rescue process after performing the reset/record process (step 509).

In the step 506, if "3" is input, then the remote administrant will request the client user to input his/her new telephone number. If the new number is successfully input, then the record will be updated (step 511). If not, then the "number changing is not completed, please try again later" voice message will be played (step 512).

It may thus be seen that the objects of the present invention set forth herein, as well as those made apparent from the foregoing description, are efficiently obtained. While the preferred embodiments of the invention have been set forth for purpose of disclosure, modifications of the disclosed embodiments of the invention as well as other embodiments thereof may occur to those skilled in the art.

Accordingly, the appended claims are intended to cover all embodiments which do not depart from the spirit and scope of the invention.

What is claimed is:

1. A control method for united home security system, said united home security system comprising a plurality of client-sides, each of the client-sides having a security peripheral sensing circuit, a client-side monitoring circuit, a remote controller, and a client-side monitor/control server, each of the servers being connected with a remote administrating and monitoring device via a public telecom-network for signal transmission, said remote administrating and monitoring device also being connected with a promulgating network via the public telecom-network, said control method comprising:

a. defining a set of signal codes which are transmitted between the client side monitor/control server and the remote administrating and monitoring device through the public telecom-network by using multiple frequency signals; said signal codes comprising a set of incident codes for the sever to call the remote administrating and monitoring device and a set of incident codes for the remote administrating and monitoring device to call the sever;

b. the remote administrating and monitoring device receiving a signal which is sent by the server and contains a data string, said data string being assembled by following a predefined format, an event handling process being performed when said data string is correct;

c. the remote administrating and monitoring device receiving and checking the incident code which is sent by the server, said incident code being assembled and compared by the remote administrating and monitoring device with said set of incident codes for the sever to call the remote administrating and monitoring device for analyzing an event which is corresponding with said incident code;

d. the remote administrating and monitoring device performing a predetermined handling process which is corresponding to said incident code, said handling process being predetermined in said set of incident codes for the remote administrating and monitoring device to call the sever, then the remote administrating and monitoring device sending a corresponded incident code to the server for instructing which specific handling process is being performed, and then said server sending back a corresponsive code to the remote administrating and monitoring device after receiving said corresponded incident code for conforming delivery thereof; and e. the remote administrating and monitoring device starting a rescue process when receiving an emergency/rescue handling signal from the server.

2. The control method for united home security system of claim 1, said predefined format of said data string being in the form of N1N2N3N4C1C2B, wherein the N1~N4 are serial numbers of client user, C1 and C2 are incident codes, B is an end-of-signal code.

3. The control method for united home security system of claim 1, wherein said set of incident codes for the sever to call the remote administrating and monitoring device comprises the following contents: first type emergency (telephone still on line), second type emergency (push the emergency button), third type emergency (oldster, children need assistance, medical assistance required), window open, glass shattered, front/rear door open, human body detected by infrared sensor (including ultrasonic sensor), rear door open, gas leakage, smoke sensor, flame/overheat detector, low power alert, alert condition setup, alert condition release, remote setting of alert condition (via telephone), and remote releasing of alert condition (via telephone).

4. The control method for united home security system of claim 1, wherein said set of incident codes for the remote administrating and monitoring device to call the sever comprises the following contents: inform server to hang up the phone, inform server to play one short-lasting and one long-lasting BEEP sounds (first type of sound), inform server to play three short-lasting and one long-lasting BEEP sounds (second type of sound), inform server to play loud and high decibel alarm sounds (third type of sound), switch on the first type monitoring device, switch on the second type receiving device, switch on the third type dialogue device, two short-lasting and one long-lasting sounds, inform server to call the pager three times and then play the first type of sound until the client user release the condition, play the second type of sound until the condition is released, play the first type of sound until the condition is released, payment overdue, switch the operation mode of the server, and send out signals.

5. The control method for united home security system of claim 1, wherein the rescue process comprises: call the male master's pager, call the female master's pager, call the male master's office telephone, call the female master's office telephone, call the first neighbor's telephone, call the second neighbor's telephone, call the police station, and call the telephone pre-determined by the client user.

* * * * *